US011261400B2

(12) United States Patent
Bahl et al.

(10) Patent No.: US 11,261,400 B2
(45) Date of Patent: Mar. 1, 2022

(54) METHOD OF SEPARATING LIPIDS FROM A LYSED LIPIDS CONTAINING BIOMASS

(71) Applicants: EVONIK OPERATIONS GMBH, Essen (DE); DSM IP ASSETS B.V., TE Heerlen (NL)

(72) Inventors: Michael Bahl, Mainhausen (DE); Marc Beiser, Nidda (DE); Jochen Lebert, Glattbach (DE); Holger Pfeifer, Wulfen (DE); Christian Rabe, Grossostheim (DE)

(73) Assignees: Evonik Operations GmbH, Essen (DE); DSM IP Assets B.V., TE Heerlen (NL)

( * ) Notice: Subject to any disclaimer, the term of this patent is extended or adjusted under 35 U.S.C. 154(b) by 0 days.

(21) Appl. No.: 16/644,443

(22) PCT Filed: Aug. 30, 2018

(86) PCT No.: PCT/EP2018/073323
§ 371 (c)(1),
(2) Date: Mar. 4, 2020

(87) PCT Pub. No.: WO2019/048327
PCT Pub. Date: Mar. 14, 2019

(65) Prior Publication Data

US 2020/0231896 A1 Jul. 23, 2020

Related U.S. Application Data

(60) Provisional application No. 62/554,359, filed on Sep. 5, 2017.

(30) Foreign Application Priority Data

Oct. 13, 2017 (EP) ..... 17196348

(51) Int. Cl.
*C11B 1/02* (2006.01)
*C11B 1/04* (2006.01)
*C11B 1/10* (2006.01)
*C11B 7/00* (2006.01)

(52) U.S. Cl.
CPC ..... *C11B 1/025* (2013.01); *C11B 1/04* (2013.01); *C11B 1/10* (2013.01); *C11B 7/0025* (2013.01)

(58) Field of Classification Search
CPC ... C11B 1/025; C11B 1/04; C11B 1/10; C11B 7/0025; C11B 1/02
See application file for complete search history.

(56) References Cited

U.S. PATENT DOCUMENTS 5,622,710 A 4/1997 Binder et al.
6,166,230 A 12/2000 Bijl et al.
6,166,231 A 12/2000 Hoeksema
6,255,505 B1 7/2001 Bijl et al.
6,410,281 B1 6/2002 Barclay
6,410,282 B1 6/2002 Kumar et al.
6,441,208 B2 8/2002 Bijl et al.
6,727,373 B2 4/2004 Bijl et al.
6,750,048 B2 6/2004 Ruecker et al.
6,977,167 B2 12/2005 Barclay
7,005,280 B2 2/2006 Barclay
7,011,962 B2 3/2006 Barclay
7,041,485 B2 5/2006 Bouarab et al.
7,163,811 B2 1/2007 Behrens et al.
7,252,979 B2 8/2007 Behrens et al.
7,351,558 B2 4/2008 Ruecker et al.
7,419,596 B2 9/2008 Dueppen et al.
7,431,952 B2 10/2008 Bijl et al.
7,470,527 B2 12/2008 Streekstra et al.
7,566,570 B2 7/2009 Abril
7,579,174 B2 8/2009 Bailey et al.
7,662,598 B2 2/2010 Ruecker et al.
7,732,170 B2 6/2010 Bailey et al.
7,776,375 B2 8/2010 Bertholet et al.
7,781,193 B2 8/2010 Ruecker et al.
7,968,737 B2 6/2011 Kawashima et al.
8,217,151 B2 7/2012 Schaap et al.
8,415,506 B2 * 4/2013 Waibel ..... C07C 45/80 568/411
9,045,785 B2 6/2015 Pfeifer, III
10,342,772 B2 7/2019 Barker et al.
10,472,316 B2 11/2019 McClements et al.
10,531,679 B2 1/2020 Rudinger et al.
10,619,175 B2 4/2020 Rabe et al.
10,842,174 B2 11/2020 Durhuus et al.
2003/0143659 A1 7/2003 Bijl et al.
(Continued)

FOREIGN PATENT DOCUMENTS

AU 2011226731 9/2011
EP 1 178 118 2/2000
(Continued)

OTHER PUBLICATIONS

Saien et al, Journal of Industrial and Engineering Chemistry, 2010, vol. 16, p. 1001-1005.*
International Search Report for PCT/EP2019/061244 filed May 2, 2019, for copending U.S. Appl. No. 17/055,083.
Written Opinion of the International Searching Authority for PCT/EP2019/061244 filed May 2, 2019, for copending U.S. Appl. No. 17/055,083.
International Preliminary Report on Patentability for PCT/EP2019/061244 filed May 2, 2019, for copending U.S. Appl. No. 17/055,083.
International Search Report for PCT/EP2019/061629 filed May 7, 2019, for copending U.S. Appl. No. 17/055,047.
Written Opinion of the International Searching Authority for PCT/EP2019/061629 filed May 7, 2019, for copending U.S. Appl. No. 17/055,047.
(Continued)

*Primary Examiner* — Kade Ariani
(74) *Attorney, Agent, or Firm* — Law Office of: Michael A. Sanzo, LLC

(57) ABSTRACT

The current invention relates to a method of separating polyunsaturated fatty acids containing lipids from a lipids containing biomass by using acetone.

20 Claims, No Drawings

(56) References Cited

U.S. PATENT DOCUMENTS

| | | | |
|---|---|---|---|
| 2007/0003686 | A1 | 1/2007 | Fichtali et al. |
| 2008/0032360 | A1 | 2/2008 | Bailey et al. |
| 2008/0032365 | A1 | 2/2008 | Bailey et al. |
| 2008/0166780 | A1 | 7/2008 | Barclay |
| 2008/0199923 | A1 | 8/2008 | Barclay |
| 2008/0233239 | A1 | 9/2008 | Avramis et al. |
| 2008/0305531 | A1 | 12/2008 | Lam et al. |
| 2009/0326267 | A1 | 12/2009 | Bijl et al. |
| 2011/0091947 | A1 | 4/2011 | Kim et al. |
| 2011/0098356 | A1 | 4/2011 | Leininger et al. |
| 2011/0124034 | A1 | 5/2011 | Kuehnle et al. |
| 2011/0201683 | A1 | 8/2011 | Bezelgues et al. |
| 2011/0295028 | A1 | 12/2011 | Cherinko et al. |
| 2012/0016145 | A1 | 1/2012 | D'Addario et al. |
| 2012/0059180 | A1 | 3/2012 | Dueppen et al. |
| 2013/0065282 | A1 | 3/2013 | Tran et al. |
| 2013/0102802 | A1 | 4/2013 | Sathish et al. |
| 2013/0172590 | A1 | 7/2013 | Pfeifer, III |
| 2014/0096437 | A1 | 4/2014 | Crowell et al. |
| 2015/0176042 | A1 | 6/2015 | Dennis et al. |
| 2016/0183565 | A1 | 6/2016 | Rudinger et al. |
| 2016/0249642 | A1 | 9/2016 | Rabe et al. |
| 2016/0289592 | A1 | 10/2016 | Massetti et al. |
| 2017/0137742 | A1 | 5/2017 | Heiska et al. |
| 2017/0290356 | A1 | 10/2017 | Silva et al. |
| 2017/0295823 | A1 | 10/2017 | Rabe et al. |
| 2017/0295824 | A1 | 10/2017 | Priefert et al. |
| 2017/0298318 | A1 | 10/2017 | Rabe et al. |
| 2017/0303561 | A1 | 10/2017 | Durhuus et al. |
| 2017/0306365 | A1 | 10/2017 | Rabe et al. |
| 2018/0071658 | A1 | 3/2018 | Hale et al. |
| 2018/0192669 | A1 | 7/2018 | Wilson |
| 2019/0249108 | A1 | 8/2019 | Cherinko |
| 2019/0300818 | A1 | 10/2019 | Bärz et al. |
| 2019/0323043 | A1 | 10/2019 | Diehl |
| 2020/0015500 | A1 | 1/2020 | De Vriendt |
| 2020/0231898 | A1 | 7/2020 | Bärz et al. |
| 2020/0339498 | A1 | 10/2020 | Heining et al. |
| 2020/0362373 | A1 | 11/2020 | Leininger et al. |
| 2020/0383353 | A1 | 12/2020 | Wilson et al. |
| 2020/0404938 | A1 | 12/2020 | Heining et al. |
| 2021/0017467 | A1 | 1/2021 | Adugna et al. |
| 2021/0024966 | A1 | 1/2021 | Heining et al. |
| 2021/0163842 | A1 | 6/2021 | Heining et al. |
| 2021/0171991 | A1 | 6/2021 | Burja et al. |
| 2021/0207056 | A1 | 7/2021 | Heining et al. |

FOREIGN PATENT DOCUMENTS

| | | | |
|---|---|---|---|
| EP | 1252324 | B1 * | 10/2010 |
| JP | H08 275793 | | 10/1996 |
| SU | 1446142 | | 12/1988 |
| WO | WO 91/07498 | | 4/1991 |
| WO | WO 94/08467 | | 4/1994 |
| WO | WO 97/36996 | | 10/1997 |
| WO | WO 97/37032 | | 10/1997 |
| WO | WO 01/53512 | | 7/2001 |
| WO | WO 01/54510 | | 8/2001 |
| WO | WO 2011/153246 | | 12/2011 |
| WO | WO 2012/109642 | | 8/2012 |
| WO | WO 2014/122087 | | 8/2014 |
| WO | WO 2014/122092 | | 8/2014 |
| WO | WO 2015/059696 | | 6/2015 |
| WO | WO 2015/095688 | | 6/2015 |
| WO | WO 2015/095693 | | 6/2015 |
| WO | WO 2015/095694 | | 6/2015 |
| WO | WO 2018/011275 | | 1/2018 |
| WO | WO 2018/011286 | | 1/2018 |
| WO | WO 2018/013670 | | 1/2018 |
| WO | WO 2018/122057 | | 7/2018 |
| WO | WO 2019/032880 | | 2/2019 |
| WO | WO 2019/063669 | | 4/2019 |
| WO | WO 2019/121752 | | 6/2019 |
| WO | WO 2019/122030 | | 6/2019 |
| WO | WO 2019/122031 | | 6/2019 |
| WO | WO 2019/191544 | | 10/2019 |
| WO | WO 2019/191545 | | 10/2019 |
| WO | WO 2019/219396 | | 11/2019 |
| WO | WO 2019/219443 | | 11/2019 |
| WO | WO 2020/036814 | | 2/2020 |
| WO | WO 2020/094750 | | 5/2020 |
| WO | WO 2020/094751 | | 5/2020 |
| WO | WO 2020/109472 | | 6/2020 |
| WO | WO 2020/123965 | | 6/2020 |

OTHER PUBLICATIONS

International Preliminary Report on Patentability for PCT/EP2019/061629 filed May 7, 2019, for copending U.S. Appl. No. 17/055,047.

Non Final Office Action for copending U.S. Appl. No. 16/317,249, dated Dec. 7, 2020.

Response to Office Action for copending U.S. Appl. No. 16/317,305, filed Dec. 11, 2020.

U.S. Appl. No. 17/055,047, filed Nov. 12, 2020, Heining.

U.S. Appl. No. 17/055,083, filed Nov. 12, 2020, Heining.

Restriction Requirement for copending U.S. Appl. No. 16/317,305, dated May 19, 2020.

Office Action for copending U.S. Appl. No. 16/473,805, dated May 28, 2020.

Restriction Requirement for copending U.S. Appl. No. 16/317,249, dated Jun. 24, 2020.

International Preliminary Report on Patentability for corresponding international application PCT/EP2018/073323 filed Aug. 30, 2018.

U.S. Appl. No. 15/315,094, filed Nov. 30, 2016, US-2018/0192669 A1, Jul. 12, 2018, Wilson.

U.S. Appl. No. 16/309,632, filed Dec. 13, 2018, US-2019/0249108 A1, Aug. 15, 2019, Cherinko.

Final Office Action for copending U.S. Appl. No. 16/317,305, dated Jan. 11, 2021.

Final Office Action for copending U.S. Appl. No. 16/473,805, dated Feb. 10, 2021.

European Search Report and Search Opinion for corresponding European application EP 17 19 6348 filed Oct. 13, 2017.

International Search Report for PCT/EP2018/085606, filed Dec. 18, 2018; for copending U.S. Appl. No. 16/956,453.

Written Opinion of the International Searching Authority for PCT/EP2018/085606, filed Dec. 18, 2018; for copending U.S. Appl. No. 16/956,453.

International Preliminary Report on Patentability for PCT/EP2018/085606, filed Dec. 18, 2018; for copending U.S. Appl. No. 16/956,453.

European Search Report and Search Opinion for European application EP 18 15 6840 filed Feb. 15, 2018, counterpart of copending U.S. Appl. No. 16/956,453.

Hu, et al.,"A review of recent developments of pre-treatment technologies and hydrothermal liquefaction of microalgae for bio-crude oil production," *Renewable and Sustainable Energy Reviews* 101:476-492 (2019).

Response to Office Action for copending U.S. Appl. No. 16/473,805, filed Aug. 28, 2020.

U.S. Appl. No. 16/956,453, filed Jun. 19, 2020, Heining.

International Search Report for corresponding international application PCT/EP2018/073323, filed Aug. 30, 2018.

Written Opinion of the International Searching Authority for corresponding international application PCT/EP2018/073323, filed Aug. 30, 2018.

International Search Report for PCT/EP2017/083712 filed Dec. 20, 2017, for copending U.S. Appl. No. 16,473,805.

Written Opinion of the International Searching Authority for PCT/EP2017/083712 filed Dec. 20, 2017, for copending U.S. Appl. No. 16,473,805.

International Preliminary Report on Patentability for corresponding international application PCT/EP2017/083712 filed Dec. 20, 2017, for copending U.S. Appl. No. 16/473,805.

European Search Report and Search Opinion for European application EP 17 15 8286 filed Feb. 28, 2017, counterpart of copending U.S. Appl. No. 16,473,805.

International Search Report for PCT/EP2017/067570, filed Jul. 12, 2017; for copending U.S. Appl. No. 16/317,249.

(56) References Cited

OTHER PUBLICATIONS

Written Opinion of the International Searching Authority for PCT/EP2017/067570, filed Jul. 12, 2017; for copending U.S. Appl. No. 16/317,249.
International Preliminaiy Report on Patentability for PCT/EP2017/067570, filed Jul. 12, 2017; for copending U.S. Appl. No. 16/317,249.
International Search Report for PCT/EP2017/067585, filed Jul. 12, 2017; for copending U.S. Appl. No. 16/317,305.
Written Opinion of the International Searching Authority for PCT/EP2017/067585, filed Jul. 12, 2017; for copending U.S. Appl. No. 16/317,305.
International Preliminary Report on Patentability for PCT/EP2017/067585, filed Jul. 12, 2017; for copending U.S. Appl. No. 16/317,305.
U.S. Appl. No. 15/027,429, filed Apr. 5, 2016, US-2016/0249642 A1, Sep. 1, 2016, Rabe, et al.
U.S. Appl. No. 15/516,022, filed Mar. 31, 2017, US-2017/0295823 A1, Oct. 19, 2017, Rabe, et al.
U.S. Appl. No. 15/516,023, filed Mar. 31, 2017, US-2017/0290356 A1, Oct. 12, 2017, Silva, et al.
U.S. Appl. No. 15/516,024, filed Mar. 31, 2017, US-2017/0295824 A1, Oct. 19, 2017, Priefert, et al.
U.S. Appl. No. 15/516,038, filed Mar. 31, 2017, US-2017/0298318 A1, Oct. 19, 2017, Rabe, et al.
U.S. Appl. No. 15/516,044, filed Mar. 31, 2017, US-2017/0306365 A1, Oct. 26, 2017, Rabe, et al.
U.S. Appl. No. 15/516,058, filed Mar. 31, 2017, US-2017/0303561 A1, Oct. 26, 2017, Durhuus, et al.
U.S. Appl. No. 16/317,249, filed Jan. 11, 2019, US-2019/0300818 A1, Oct. 3, 2019, Bärz, et al.
U.S. Appl. No. 16/317,305, filed Jan. 11, 2019, Bärz, et al.
U.S. Appl. No. 16/473,805, filed Jun. 26, 2019, US-2019/0323043 A1, Oct. 24, 2019, Diehl.
U.S. Appl. No. 16/639,529, filed Feb. 14, 2020, Burja.
Response to Restriction Requirement for copending U.S. Appl. No. 16/317,305, filed Jul. 20, 2020.
Response to Restriction Requirement for copending U.S. Appl. No. 16/317,249, filed Aug. 24, 2020.
Office Action for copending U.S. Appl. No. 16/317,305, dated Aug. 13, 2020.
Amendment & Response to Final Office Action for copending U.S. Appl. No. 16/317,305, filed May 7, 2021.
Amendment & Response to Non Final Office Action for copending U.S. Appl. No. 16/317,249, filed May 7, 2021.
Restriction Requirement for copending U.S. Appl. No. 16/956,453, dated May 20, 2021.
Request for Continued Examination for copending U.S. Appl. No. 16/473,805, filed Jun. 10, 2021.
Amendment & Response to Accompany Request for Continued Examination for copending U.S. Appl. No. 16/473,805, filed Jun. 10, 2021.
Non Final Office Action for copending U.S. Appl. No. 16/317,305, dated Jun. 4, 2021.
Response to Restriction Requirement for copending U.S. Appl. No. 16/956,453, filed Jul. 14, 2021.
Non Final Office Action for copending U.S. Appl. No. 16/956,453, dated Aug. 2, 2021.
CFSTR (Continuous Flow Stirred Tank Reactor, Chapter 8, Sec. 2, pp. 1-2, published online Dec. 2010) (Year 2010).
U.S. Appl. No. 16/469,286, filed Jun. 13, 2019, US-2020/0015500 A1, Jan. 16, 2020, De Vriendt.
U.S. Appl. No. 16/636,940, filed Feb. 6, 2020, US-2020/0362373 A1, Nov. 19, 2020, Leininger.
U.S. Appl. No. 16/886,691, filed May 28, 2020, US-2020/0383353 A1, Dec. 10, 2020, Wilson.
U.S. Appl. No. 16/956,820, filed Jun. 22, 2020, US-2020/0404938 A1, Dec. 31, 2020, Heining.
U.S. Appl. No. 17/042,788, filed Sep. 28, 2020, US-2021/0024966 A1, Jan. 28, 2021, Heining.
U.S. Appl. No. 17/042,791, filed Sep. 28, 2020, US-2021/0017467 A1, Jan. 21, 2021, Adugna.
U.S. Appl. No. 17/284,463, filed Apr. 10, 2021, Erickson.
U.S. Appl. No. 17/291,608, filed May 6, 2021, Priefert.
U.S. Appl. No. 17/291,610, filed May 6, 2021, Priefert.

* cited by examiner

METHOD OF SEPARATING LIPIDS FROM A LYSED LIPIDS CONTAINING BIOMASS

CROSS REFERENCE TO RELATED APPLICATIONS

The present application is US national stage of international application PCT/EP2018/073323, which had an international filing date of Aug. 30, 2018, and which was published on March 14, 2019. The PCT application claims the benefit of U.S. provisional application 62/554,359, filed on Sep. 5, 2017 and priority to European application EP 17196348.1, filed on Oct. 13, 2017. The contents of each of these applications is hereby incorporated by reference in its entirety.

The current invention relates to a method of separating polyunsaturated fatty acids containing lipids from a lipids containing biomass by using acetone.

PUFAs (polyunsaturated fatty acids) containing lipids are of high interest in the feed, food and pharmaceutical industry. Due to overfishing there is a high need for alternative sources for PUFAs containing lipids besides fish oil. It turned out that besides certain yeast and algal strains in particular microalgal cells like those of the order Thraustochytriales are a very good source for PUFAs containing lipids.

But with respect to microbial organisms and in particular cells of the order Thraustochytriales, which produce the PUFAs containing lipids, the isolation of the oil from the cells turned out as a particular problem. The most effective way of isolating the oil was the use of organic solvents like hexane. But the use of organic solvents like hexane leads to hazardous operating conditions, requires the use of expensive explosion-proof equipment and requires the implementation of an expensive solvent recovery process to avoid pollution of the environment.

In the attempt to avoid the use of organic solvents, which lead to hazardous operating conditions, as an effective alternative way for isolating the oil has turned out the salting-out of the oil with high amounts of sodium chloride. But the use of high amounts of sodium chloride leads to a delipidated biomass by-product which due to the high salt content cannot be utilized as a feed ingredient, so that the process is not very sustainable. Further, the high salt concentration leads to fast corrosion of the used steel equipment.

Thus, it was the object of the current invention to provide an effective method for isolating a lipid, in particular a PUFAs containing lipid, from lipids containing cells, in particular of the order Thraustochytriales, and simultaneously avoiding not only the need of organic solvents, which lead to hazardous operating conditions, but further avoid the need of high amounts of salts for realizing the effective isolation of the oil from the cells.

It was a further object of the current invention to provide a method for isolating a lipid, in particular a PUFAs containing lipid, from lipids containing cells, in particular of the order Thraustochytriales, and simultaneously providing a delipidated biomass which can be utilized in a commercial way, preferably in the agricultural field.

It turned out that a very efficient separation of the lipid from the cell debris containing aqueous phase can be realized, if acetone is used as solvent for isolating the oil from the biomass. In contrast to hexane, acetone does not lead to hazardous operating conditions and it turned out as a further advantage that it can be removed easily after the isolation of the oil from the lysed biomass. Due to its surprisingly easy separation and recovery, acetone can be recycled in the process and thus a sustainable ecological isolation process is provided according to the current invention.

A further advantage of the current process in comparison to processes for the isolation of the oil as disclosed in the state of the art is that it can be carried out quite quickly, in particular also at neutral pH values, i.e. the process is less cost- and time-intensive in comparison to current processes for the isolation of the oil as disclosed in the state of the art.

Thus, a first subject of the current invention is a method of separating a polyunsaturated fatty acids (PUFAs) containing lipid from the debris of a biomass, comprising the following steps:

a) Providing a suspension of a biomass comprising cells which contain a PUFAs containing lipid;
b) Lysing the cells of the biomass;
c) Adding to the suspension as obtained in step (b) acetone, until a final amount of between 25 and 47.5 wt.-% of acetone is reached;
d) Thoroughly mixing the suspension as obtained in step (c);
e) Separating the oil and acetone containing light phase as obtained in step (d) from the water, acetone, salt and cell debris containing heavy phase.

In step (c) acetone is preferably added, until a final amount of between 27.5 and 45.0, in particular 30.0 to 42.5, more preferably of between 30.0 to 40.0 wt.-% of acetone is reached.

Preferably, in the steps (b), (c) and (d) of the method the suspension is continuously mixed by using a stirrer and/or an agitator. In the method steps (c) and/or (d) preferably low shear agitation and/or axial-flow agitation is applied, in particular as disclosed in WO 2015/095694. Impellers suitable for agitating prior and during steps (c) and/or (d) include in particular straight blade impellers, Rushton blade impellers, axial flow impellers, radial flow impellers, concave blade disc impellers, high-efficiency impellers, propellers, paddles, turbines and combinations thereof.

Preferably the acetone treatment, i.e. steps (c) to (e), is carried out at a temperature of between 10 and 50° C., more preferably 15 to 40° C., above all 18 to 35° C., in particular at about room temperature.

Lysing of the cells of the biomass can be carried out by methods as known to those skilled in the art, in particular enzymatically, mechanically, physically, or chemically, or by applying combinations thereof.

Depending on the time of exposure and/or the degree of force applied, a composition comprising only lysed cells or a composition comprising a mixture of cell debris and intact cells may be obtained. The term "lysed lipids containing biomass" insofar relates to a suspension which contains water, cell debris and oil as set free by the cells of the biomass, but beyond that may also comprise further components, in particular salts, intact cells, further contents of the lysed cells as well as components of a fermentation medium, in particular nutrients. In a preferred embodiment of the invention, only small amounts of intact cells, in particular less than 20%, preferably less than 10%, more preferably less than 5% (relating to the total number of intact cells as present before lysing the cells of the biomass) are present in the lysed biomass after the step of lysing the cells.

Lysing of the cells may be realized for example by utilizing a French cell press, sonicator, homogenizer, microfluidizer, ball mill, rod mill, pebble mill, bead mill, high pressure grinding roll, vertical shaft impactor, industrial blender, high shear mixer, paddle mixer, and/or polytron homogenizer.

In a preferred embodiment of the invention, lysing of the cells comprises an enzymatic treatment of the cells by applying a cell-wall degrading enzyme.

According to the invention, the cell-wall degrading enzyme is preferably selected from proteases, cellulases (e.g., Cellustar CL (Dyadic), Fibrezyme G2000 (Dyadic), Celluclast (Novozymes), Fungamyl (Novozymes), Viscozyme L (Novozymes)), hemicellulases, chitinases, pectinases (e.g., Pectinex (Novozymes)), sucrases, maltases, lactases, alpha-glucosidases, beta-glucosidases, amylases (e.g., Alphastar Plus (Dyadic); Termamyl (Novozymes)), lysozymes, neuraminidases, galactosidases, alpha-mannosidases, glucuronidases, hyaluronidases, pullulanases, glucocerebrosidases, galactosylceramidases, acetylgalactosaminidases, fucosidases, hexosaminidases, iduronidases, maltases-glucoamylases, xylanases (e.g., Xylanase Plus (Dyadic), Pentopan (Novozymes)), beta-glucanases (e.g., Vinoflow Max (Novozymes), Brewzyme LP (Dyadic)), mannanases, and combinations thereof. The protease may be selected from serine proteases, threonine proteases, cysteine proteases, aspartate proteases, metalloproteases, glutamic acid proteases, alcalases (subtilisins), and combinations thereof. The chitinase may be a chitotriosidase. The pectinase may be selected from pectolyases, pectozymes, polygalacturonases, and combinations thereof.

The adequate pH for utilizing the enzyme depends on the pH optimum of the enzyme.

In a preferred embodiment of the invention, an enzyme with a pH optimum of between 6.5 and 8.5, preferably of between 7.0 and 8.0, in particular of about 7.5, is used, so that the pH applied in this step is from 6.5 to 8.5, in particular 7.0 to 8.0, preferably from 7.3 to 7.7. A preferred enzyme which can be used in this pH range is an alcalase.

The enzyme is preferably added as a concentrated enzyme solution, preferably in an amount of 0.01 to 1.5 wt.-%, more preferably in an amount of 0.03 to 1.0 wt.-%, above all in an amount of 0.05 to 0.5 wt.-%, relating to the amount of concentrated enzyme solution as added in relation to the total amount of the suspension after addition of the concentrated enzyme solution.

In a very preferred embodiment of the invention, lysing of the cells is carried out as follows:

i) Heating the suspension of (a) to a temperature of between 50° C. and 70° C., preferably to a temperature of between 55° C. and 65° C., and adding a cell wall-degrading enzyme to the fermentation broth, and adjusting an adequate pH value, if necessary, at which the enzyme is properly working;

ii) Keeping the temperature and pH in the ranges as depicted in (i) for at least one hour, preferably for at least two hours, more preferably for two to four hours.

In step (i), the enzyme can be added before or after heating up the suspension and/or before or after adjusting the pH. In the same way heating up of the suspension can be carried out before or after adjusting the pH. —But in a preferred embodiment, the enzyme is added after heating up of the suspension and after adjusting the pH, if adjusting of the pH is necessary, at all. —In a very preferred embodiment all measures are carried out more or less simultaneously.

Preferably, in the steps (i) and (ii) the suspension is continuously mixed by using a stirrer and/or an agitator.

In a preferred embodiment of the invention, the isolation of the oil is carried out with a suspension having a dry matter content of 30 to 60 wt.-%, preferably 35 to 55 wt. %, in particular 40 to 50 wt.-%. This can be realized by either providing a suspension with an appropriately high biomass in step (a) or by concentrating the suspension as obtained by lysing the cells of the biomass in step (b). Thus, in a preferred embodiment of the invention, after lysing the cells of the biomass and before the addition of acetone, the suspension is concentrated to a total dry matter content of 30 to 60 wt.-%, more preferably 35 to 55 wt.-%, in particular 40 to 50 wt.-%.

Concentration of the suspension is preferably carried out by evaporation of water at a temperature not higher than 100° C., preferably 70° C. to 100° C., more preferably 80° C. to 90° C., until a total dry matter content of 30 to 60 wt.-% more preferably 35 to 55 wt.-%, in particular 40 to 50 wt.-%, is reached.

Concentration of the suspension is preferably carried out in a forced circulation evaporator (for example available from GEA, Germany) to allow fast removal of the water.

Isolation of the oil from the lysed biomass with acetone is principally working at a broad range of pH values. But as isolation of the oil is better working at an acidic pH value, in a particularly preferred embodiment of the invention isolation of the oil is carried out at an acidic pH value, particular at a pH value of 2.5 to 6.8, more preferably at a pH value of 3.0 to 6.0. —Thus, if necessary, in this particularly preferred embodiment the pH value is adjusted to 2.5 to 6.8, in particular to 3.0 to 6.0, before addition of the acetone.

In a particularly preferred embodiment of the invention, isolation of the oil is carried out at a pH value of between 2.5 and 4.0, more preferably at a pH value of between 2.5 and 3.5.

In another particularly preferred embodiment of the invention, isolation of the oil is carried out at a pH value of between 5.0 and 6.0.

In a further particularly preferred embodiment of the invention, isolation of the oil is carried out at a pH value of between 7.5 and 8.5.

In a further particularly preferred embodiment of the invention, isolation of the oil is carried out at a pH value of between 10.0 and 11.0.

In general, adjusting the pH value can be carried out according to the invention by using either bases or acids as known to those skilled in the art. Decreasing of the pH can be carried out in particular by using organic or inorganic acids like sulfuric acid, nitric acid, phosphoric acid, boric acid, hydrochloric acid, hydrobromic acid, perchloric acid, hypochlorous acid, chlorous acid, fluorosulfuric acid, hexafluorophosphoric acid, acetic acid, citric acid, formic acid, or combinations thereof. As a high content of chloride is desirably avoided, in a preferred embodiment of the invention no or only small amounts of hydrochloric acid are used in the process of the current invention. According to the invention, sulfuric acid is the preferred substance for decreasing the pH value. —Increasing of the pH can be carried out in particular by using organic or inorganic bases like hydroxides, in particular sodium hydroxide, lithium hydroxide, potassium hydroxide, and/or calcium hydroxide, carbonates, in particular sodium carbonate, potassium carbonate, or magnesium carbonate, and/or bicarbonates, in particular lithium bicarbonate, sodium bicarbonate, and/or potassium bicarbonate. —Due to easiness of handling, the acids and bases are preferably used in liquid form, in particular as concentrated solutions, wherein the concentration of acid or base in the solution is preferably in the range of 10 to 55 wt.-%, in particular in the range of 20 to 50 wt.-%.

The method according to the invention comprises as a further step the separation of the oil and acetone containing light phase, as obtained in step (d), from the water, acetone, salt and cell debris containing heavy phase.

Separation of the light phase from the heavy phase is preferably realized by mechanical means and preferably at a temperature of 10-50° C., more preferably 15-40° C., above all 18-35° C., in particular at about room temperature. "Mechanical means" refers in particular to filtration and centrifugation methods as known to those skilled in the art.

Separation of the light phase from the heavy phase can be carried out at the pH value as present in the suspension as obtained in step (d). —But preferably separation of the light phase from the heavy phase is carried out at a pH value of 5.5 to 8.5, more preferably 6.0 to 8.0, in particular 6.5 to 7.5. Thus, in a preferred embodiment of the invention, before carrying out the separation of the light phase from the heavy phase, a pH value as depicted before is adjusted.

After separation of the oil and acetone containing light phase, the acetone can easily be separated from the PUFAs containing oil by solvent evaporation. Surprisingly the solvent evaporation works so efficiently, that no detectable amounts of acetone remain in the oil.

Solvent separation is preferably carried out at a temperature of between 40 and 56° C. and preferably at lowered pressure of below 500 mbar, in particular below 200 mbar, which can be realized by applying a vacuum pump. As an alternative or in addition, acetone can be separated from the oil by exposing the light phase to a current of an inert gas, preferably nitrogen.

Subsequently the purified oil thus obtained can further be worked up by applying methods as known to those skilled in the art, in particular refining, bleaching, deodorizing and/or winterizing.

A particular advantage of the method of the current invention is that it can be carried out without the use of any toxic organic solvents like hexane, so that the method is environmentally friendly.

A further advantage of the method of the current invention is that a very efficient separation of the oil from the remaining biomass can be realized without the addition of sodium chloride, which is normally used for salting out the oil from the biomass. Preferably the method can be carried out without the addition of chloride salts, at all, above all without the addition of any salts for salting out the oil. But small amounts of chloride salts, in particular sodium chloride, might be present in the suspension due to the fermentation medium as used for growing of the biomass.

Thus, in a preferred embodiment of the current invention, no or only little amounts of sodium chloride are used for improving the oil isolation. In a preferred embodiment of the invention less than 1 wt.-% of sodium chloride, are used, more preferably less than 0.5 or 0.2 wt.-% of sodium chloride are used for isolating the oil from the biomass, above all less than 0.1 or 0.05 wt.-%, wherein the wt.-% relate to the total weight of the composition after addition of the sodium chloride. —This means in particular for this embodiment that the suspension as employed in the method according to the invention preferably contains sodium chloride in an amount of less than 2 wt.-%, more preferably less than 1 wt.-%, in particular less than 0.5 or 0.3 wt.-%, above all in an amount of less than 0.1 or 0.05 wt.-%.

In a particularly preferred embodiment of the invention no or only little amounts of chloride salts are used for improving the oil isolation, at all. In this embodiment preferably less than 1 wt.-% of chloride salts, more preferably less than 0.5 or 0.2 wt.-% of chloride salts are used for isolating the oil from the biomass, above all less than 0.1 or 0.05 wt.-%, wherein the wt.-% relate to the total weight of the composition after addition of the chloride salts. —This means in particular for this embodiment that the suspension as employed in the method according to the invention preferably contains chloride, in particular chloride salts, in an amount of less than 2 wt.-%, more preferably less than 1 wt.-%, in particular less than 0.5 or 0.3 wt.-%, above all in an amount of less than 0.1 or 0.05 wt.-%.

In a very preferred embodiment of the invention no or only little amounts of salts are used for improving the oil isolation, in general. In this embodiment preferably less than 1 wt.-% of salts, more preferably less than 0.5 or 0.2 wt.-% of salts are used for isolating the oil from the biomass, above all less than 0.1 or 0.05 wt.-%, wherein the wt.-% relate to the total weight of the composition after addition of the salts. —This means in particular for this embodiment that the suspension as employed in the method according to the invention preferably contains salts in general in an amount of less than 2 wt.-%, more preferably less than 1 wt.-%, in particular less than 0.5 or 0.3 wt.-%, above all in an amount of less than 0.1 or 0.05 wt.-%.

The methods of the current invention allow a very efficient separation of the oil contained in the biomass from the cell debris and other substances as contained in the fermentation broth. By using the methods of the current invention preferably more than 80 wt.-%, in particular more than 90 wt.-% of the oil contained in the biomass can be separated from the biomass and isolated.

"Chloride" according to the invention refers to the amount of detectable chlorine. The amount of chlorine as present can be determined for example by elemental analysis according to DIN EN ISO 11885. The chlorine is present in the form of salts which are called "chlorides". The content of chloride as mentioned according to the invention—also called "chloride ions"—only refers to the amount of detectable chlorine, not to the amount of the complete chloride salt, which comprises besides the chloride ion also a cationic counterion.

The method according to the invention may further comprise as a pretreatment step the pasteurization of the suspension of the biomass, before carrying out the lysis of the cells. The pasteurization is preferably carried out for 5 to 120 minutes, in particular 20 to 100 minutes, at a temperature of 50 to 121° C., in particular 50 to 70° C.

The PUFAs containing cells of the biomass are preferably microbial cells or plant cells. Preferably, the cells are capable of producing the PUFAs due to a polyketide synthase system. The polyketide synthase system may be an endogenous one or, due to genetic engineering, an exogenous one.

The plant cells may in particular be selected from cells of the families Brassicaceae, Elaeagnaceae and Fabaceae. The cells of the family Brassicaceae may be selected from the genus Brassica, in particular from oilseed rape, turnip rape and Indian mustard; the cells of the family Elaeagnaceae may be selected from the genus Elaeagnus, in particular from the species Oleae europaea; the cells of the family Fabaceae may be selected from the genus Glycine, in particular from the species Glycine max.

The microbial organisms which contain a PUFAs containing lipid are described extensively in the prior art. The cells used may, in this context, in particular be cells which already naturally produce PUFAs (polyunsaturated fatty acids); however, they may also be cells which, as the result of suitable genetic engineering methods or due to random mutagenesis, show an improved production of PUFAs or have been made capable of producing PUFAs, at all. The production of the PUFAs may be auxotrophic, mixotrophic or heterotrophic.

The biomass preferably comprises cells which produce PUFAs heterotrophically. The cells according to the invention are preferably selected from algae, fungi, particularly yeasts, bacteria, or protists. The cells are more preferably microbial algae or fungi.

Suitable cells of oil-producing yeasts are, in particular, strains of Yarrowia, Candida, Rhodotorula, Rhodosporidium, Cryptococcus, Trichosporon and Lipomyces.

Suitable cells of oil-producing microalgae and algae-like microorganisms are, in particular, microorganisms selected from the phylum Stramenopiles (also called Heterokonta). The microorganisms of the phylum Stramenopiles may in particular be selected from the following groups of microorganisms: Hamatores, Proteromonads, Opalines, Developayella, Diplophrys, Labrinthulids, Thraustochytrids, Biosecids, Oomycetes, Hypochytridiomycetes, Commation, Reticulosphaera, Pelagomonas, Pelagococcus, Ollicola, Aureococcus, Parmales, Diatoms, Xanthophytes, Phaeophytes (brown algae), Eustigmatophytes, Raphidophytes, Synurids, Axodines (including Rhizochromulinales, Pedinellales, Dictyochales), Chrysomeridales, Sarcinochrysidales, Hydrurales, Hibberdiales, and Chromulinales. Other preferred groups of microalgae include the members of the green algae and dinoflagellates, including members of the genus Crypthecodiurn.

The biomass according to the invention preferably comprises cells, and preferably consists essentially of such cells, of the taxon Labyrinthulomycetes (Labyrinthulea, net slime fungi, slime nets), in particular those from the family of Thraustochytriaceae. The family of the Thraustochytriaceae (Thraustochytrids) includes the genera Althomia, Aplanochytrium, Aurantiochytrium, Botryochytrium, Elnia, Japonochytrium, Oblongichytrium, Parietichytrium, Schizochytrium, Sicyoidochytrium, Thraustochytrium, and Ulkenia. The biomass particularly preferably comprises cells from the genera Aurantiochytrium, Oblongichytrium, Schizochytrium, or Thraustochytrium, above all from the genus Schizochytrium.

In accordance with the invention, the polyunsaturated fatty acid (PUFA) is preferably a highly-unsaturated fatty acid (HUFA).

The cells present in the biomass are preferably distinguished by the fact that they contain at least 20% by weight, preferably at least 30% by weight, in particular at least 35% by weight, of PUFAs, in each case based on cell dry matter.

According to the current invention, the term "lipid" includes phospholipids; free fatty acids; esters of fatty acids; triacylglycerols; sterols and sterol esters; carotenoids; xanthophylls (e. g. oxycarotenoids); hydrocarbons; isoprenoid-derived compounds and other lipids known to one of ordinary skill in the art. —The terms "lipid" and "oil" are used interchangeably according to the invention.

In a preferred embodiment, the majority of the lipids in this case is present in the form of triglycerides, with preferably at least 50% by weight, in particular at least 75% by weight and, in an especially preferred embodiment, at least 90% by weight of the lipids present in the cell being present in the form of triglycerides.

According to the invention, polyunsaturated fatty acids (PUFAs) are understood to mean fatty acids having at least two, particularly at least three, C—C double bonds. According to the invention, highly-unsaturated fatty acids (HUFAs) are preferred among the PUFAs. According to the invention, HUFAs are understood to mean fatty acids having at least four C—C double bonds.

The PUFAs may be present in the cell in free form or in bound form. Examples of the presence in bound form are phospholipids and esters of the PUFAs, in particular monoacyl-, diacyl- and triacylglycerides. In a preferred embodiment, the majority of the PUFAs is present in the form of triglycerides, with preferably at least 50% by weight, in particular at least 75% by weight and, in an especially preferred embodiment, at least 90% by weight of the PUFAs present in the cell being present in the form of triglycerides.

Preferred PUFAs are omega-3 fatty acids and omega-6 fatty acids, with omega-3 fatty acids being especially preferred. Preferred omega-3 fatty acids here are the eicosapentaenoic acid (EPA, 20:5ω-3), particularly the (5Z,8Z,11Z,14Z,17Z)-eicosa-5,8,11,14,17-pentaenoic acid, and the docosahexaenoic acid (DHA, 22:6ω-3), particularly the (4Z,7Z,10Z,13Z,16Z,19Z)-docosa-4,7,10,13,16,19-hexaenoic acid.

In a very preferred embodiment of the current invention, cells, in particular a Schizochytrium strain, is employed which produces a significant amount of EPA and DHA, simultaneously, wherein DHA is preferably produced in an amount of at least 20 wt.-%, preferably in an amount of at least 30 wt.-%, in particular in an amount of 30 to 50 wt.-%, and EPA is produced in an amount of at least 5 wt.-%, preferably in an amount of at least 10 wt.-%, in particular in an amount of 10 to 20 wt.-% (in relation to the total amount of lipid as contained in the cells, respectively). DHA and EPA producing Schizochytrium strains can be obtained by consecutive mutagenesis followed by suitable selection of mutant strains which demonstrate superior EPA and DHA production and a specific EPA:DHA ratio. Any chemical or nonchemical (e.g. ultraviolet (UV) radiation) agent capable of inducing genetic change to the yeast cell can be used as the mutagen. These agents can be used alone or in combination with one another, and the chemical agents can be used neat or with a solvent.

Preferred species of microorganisms of the genus Schizochytrium, which produce EPA and DHA simultaneously in significant amounts, as mentioned before, are deposited under ATCC Accession No. PTA-10208, PTA-10209, PTA-10210, or PTA-10211, PTA-10212, PTA-10213, PTA-10214, PTA-10215.

The suspension of biomass according to the present invention has preferably a biomass density of at least 80 or 100 g/l, preferably at least 120 or 140 g/l, more preferably at least 160 or 180 g/l (calculated as dry-matter content). The suspension according to the invention is preferably a fermentation broth. Thus, the suspension may be obtained by culturing and growing suitable cells in a fermentation medium under conditions whereby the PUFAs are produced by the microorganism.

Methods for producing the biomass, in particular a biomass which comprises cells containing lipids, in particular PUFAs, particularly of the order Thraustochytriales, are described in detail in the prior art (see e.g. WO91/07498, WO94/08467, WO97/37032, WO97/36996, WO01/54510). As a rule, the production takes place by cells being cultured in a fermenter in the presence of a carbon source and of a nitrogen source, along with a number of additional substances like minerals that allow growth of the microorganisms and production of the PUFAs. In this context, biomass densities of more than 100 grams per litre and production rates of more than 0.5 gram of lipid per litre per hour may be attained. The process is preferably carried out in what is known as a fed-batch process, i.e. the carbon and nitrogen sources are fed in incrementally during the fermentation. When the desired biomass has been obtained, lipid production may be induced by various measures, for example by limiting the nitrogen source, the carbon source or the oxygen content or combinations of these.

In a preferred embodiment of the current invention, the cells are grown until they reach a biomass density of at least 80 or 100 g/l, more preferably at least 120 or 140 g/l, in particular at least 160 or 180 g/l (calculated as dry-matter content). Such processes are for example disclosed in U.S. Pat. No. 7,732,170. Preferably, the cells are fermented in a medium with low salinity, in particular so as to avoid corrosion. This can be achieved by using chlorine-free sodium salts as the sodium source instead of sodium chloride, such as, for example, sodium sulphate, sodium carbonate, sodium hydrogen carbonate or soda ash. Preferably, chloride is used in the fermentation in amounts of less than 3 g/l, in particular less than 500 mg/l, especially preferably less than 100 mg/l.

Suitable carbon sources are both alcoholic and non-alcoholic carbon sources. Examples of alcoholic carbon sources are methanol, ethanol and isopropanol. Examples of non-alcoholic carbon sources are fructose, glucose, sucrose, molasses, starch and corn syrup.

Suitable nitrogen sources are both inorganic and organic nitrogen sources. Examples of inorganic nitrogen sources are nitrates and ammonium salts, in particular ammonium sulphate and ammonium hydroxide. Examples of organic nitrogen sources are amino acids, in particular glutamate, and urea.

In addition, inorganic or organic phosphorus compounds and/or known growth-stimulating substances such as, for example, yeast extract or corn steep liquor, may also be added so as to have a positive effect on the fermentation.

The cells are preferably fermented at a pH of 3 to 11, in particular 4 to 10, and preferably at a temperature of at least 20° C., in particular 20 to 40° C., especially preferably at least 30° C. A typical fermentation process takes up to approximately 100 hours.

After the fermentation has ended, the cells may be pasteurized in order to kill the cells and to deactivate enzymes which might promote lipid degradation. The pasteurization is preferably effected by heating the biomass to a temperature of 50 to 121° C., preferably 50 to 70° C., for a period of 5 to 80 minutes, in particular 20 to 60 minutes.

Likewise, after the fermentation is ended, antioxidants may be added in order to protect the PUFAs present in the biomass from oxidative degradation. Preferred antioxidants in this context are BHT, BHA, TBHA, ethoxyquin, beta-carotene, vitamin E, in particular tocopherol, and vitamin C. The antioxidant, if used, is preferably added in an amount of 0.001 to 0.1 wt.-%, preferably in an amount of 0.002 to 0.05 wt.-%, relating to the total amount of the fermentation broth after addition of the antioxidant.

WORKING EXAMPLES

Example 1

An unwashed cell broth containing microbial cells (Schizochytrium sp.) at a biomass density of over 100 g/l was heated to 60° C. in an agitated vessel. After heating up the suspension, the pH was adjusted to 7.5 by using caustic soda (50 wt.-% NaOH solution), before an alcalase (Alcalase® 2.4 FG (Novozymes)) was added in liquid form in an amount of 0.5 wt.-% (by weight broth). Stirring was continued for 3 hours at 60° C. After that, the lysed cell mixture was transferred into a forced circulation evaporator (obtained from GEA, Germany) and heated to a temperature of 85° C. The mixture was concentrated in the forced circulation evaporator, until a total dry matter content of about 30 wt.-% was reached.

Fractions of the concentrated lysed cell mixture were then taken and a specific pH value was adjusted by either using NaOH or $H_2SO_4$, resulting in aliquots with a pH value of 3.1, 5.6, 8.1 and 10.4.

Subsequently aliquots of those fractions were mixed with different amounts of acetone which were added to those aliquots at room temperature. After addition of acetone, the resulting suspensions were thoroughly mixed by using a vortex. After mixing, phase separation was carried out by using a centrifuge.

After centrifugation, it was first determined whether an oil containing phase was obtainable. If an oil containing phase was obtained, then the amount of oil as contained in this phase in comparison to the total amount of oil as contained in the biomass at the beginning was determined. The results are disclosed in the following tables.

TABLE 1

Acetone extraction at a pH of 3.1

| | | | | | | | | | |
|---|---|---|---|---|---|---|---|---|---|
| Acetone [wt.-%] | 27.5 | 30 | 32.5 | 35 | 37.5 | 40 | 42.5 | 45 | 47.5 |
| Lysed broth [g] | 29.0 | 28.2 | 27.3 | 26.0 | 25.0 | 24.2 | 23.1 | 22.1 | 21.2 |
| Acetone [g] | 11.1 | 12.5 | 13.2 | 14.1 | 15.4 | 16.6 | 17.2 | 18.6 | 19.2 |
| Isolated oil [wt.-%] | 88.3 | 84.8 | 75.2 | 81.0 | 74.3 | 72.1 | 78.1 | 60.4 | 61.3 |

TABLE 2

Acetone extraction at a pH of 5.6

| | | | | | | | | | |
|---|---|---|---|---|---|---|---|---|---|
| Acetone [wt.-%] | 27.5 | 30 | 32.5 | 35 | 37.5 | 40 | 42.5 | 45 | 47.5 |
| Lysed broth [g] | 29.1 | 28.0 | 27.0 | 26.2 | 25.1 | 24.1 | 23.1 | 22.0 | 21.0 |
| Acetone [g] | 11.1 | 12.2 | 13.3 | 14.1 | 15.1 | 16.1 | 17.1 | 18.0 | 19.2 |
| Isolated oil [wt.-%] | 73.3 | 74.7 | 65.6 | 73.7 | 71.2 | 60.9 | 70.6 | 64.6 | 34.7 |

TABLE 3

| Acetone extraction at a pH of 8.1 | | | | | | | | | |
|---|---|---|---|---|---|---|---|---|---|
| Acetone [wt.-%] | 25 | 27.5 | 30 | 32.5 | 37.5 | 40 | 42.5 | 45 | 47.5 |
| Lysed broth [g] | 30.1 | 29.2 | 28.1 | 27.3 | 25.0 | 24.2 | 23.0 | 22.0 | 21.0 |
| Acetone [g] | 10.1 | 11.3 | 12.2 | 13.4 | 15.0 | 16.2 | 17.0 | 18.2 | 19.8 |
| Isolated oil [wt.-%] | 54.8 | 61.3 | 67.2 | 52.1 | 61.3 | 61.3 | 41.0 | 45.2 | 36.0 |

TABLE 4

| Acetone extraction at a pH of 10.4 | | | | | | | | | |
|---|---|---|---|---|---|---|---|---|---|
| Acetone [wt.-%] | 25 | 27.5 | 30 | 35 | 37.5 | 40 | 42.5 | 45 | 47.5 |
| Lysed broth [g] | 30.0 | 29.0 | 28.0 | 26.1 | 25.0 | 24.1 | 23.0 | 22.0 | 21.0 |
| Acetone [g] | 10.3 | 11.0 | 12.3 | 14.4 | 15.1 | 16.1 | 17.1 | 18.1 | 19.0 |
| Isolated oil [wt.-%] | 68.1 | 62.1 | 51.5 | 62.3 | 47.3 | 71.0 | 57.2 | 62.5 | 76.0 |

As can be learnt from the table, acetone turned out to be a good means for isolating the oil from the biomass, if the amount of acetone was in the range of between 25.0 and 47.5 wt.-%, calculated on basis of the final suspension as obtained after addition of acetone. —If acetone was in that range, then an oil containing phase was observed on top of the centrifuged suspension, which contained besides oil also small amounts of acetone and water. —In case that the amount of acetone was either higher than 47.5 wt.-% or lower then 25.0 wt.-%, no phase separation could be observed.

Further it turned out that oil isolation seem to work better at acidic pH values.

After separation of the oil containing phase, the residual water and acetone can easily be removed by evaporation.

The invention claimed is:

1. A method of separating polyunsaturated fatty acids (PUFAs) containing lipid from the debris of a biomass, comprising the steps:

a) providing a suspension of a biomass comprising cells which contain a PUFAs containing lipid;

b) lysing the cells of the biomass;

c) adding acetone to the suspension obtained in step (b) until a final amount of between 25 and 47.5 wt.-% of acetone is reached;

d) thoroughly mixing the suspension obtained in step (c);

e) separating an oil containing PUFAs and acetone-containing light phase obtained in step (d) from a water, acetone, salt and cell debris containing heavy phase.

2. The method of claim 1, wherein acetone is added to the suspension of biomass in step (c) until a final amount of between 27.5 and 45.0, wt.-% of acetone is reached.

3. The method of claim 1, wherein mixing of the suspension in step (d) is carried out by shaking, stirring and/or vortexing.

4. The method of claim 1, wherein lysing of the cells of the biomass is carried out enzymatically, mechanically, chemically and/or physically.

5. The method of claim 4, wherein lysing of the cells of the biomass comprises an enzymatic treatment of the cells with a cell wall degrading enzyme.

6. The method of claim 5, wherein lysing of the cells of the biomass is carried by a method comprising:

a) heating the suspension of biomass to a temperature of between 50° C. and 70° C., adding a cell wall-degrading enzyme to the fermentation broth, and, if necessary, adjusting the pH to a value at which the enzyme is active;

b) maintaining the temperature and pH in the ranges of paragraph a) for at least one hour.

7. The method of claim 1, wherein after lysing the cells, the suspension is concentrated to a total dry matter content of 30 to 60 wt-%.

8. The method of claim 1, wherein steps (c) to (e) are carried out at a temperature of 10 to 50° C.

9. The method of claim 1, wherein, before addition of acetone in step (c), the pH of the suspension is adjusted to an acidic pH.

10. The method of claim 9, wherein before addition of acetone in step (c), the pH is adjusted to a an acidic pH of 2.5 to 6.8.

11. The method of claim 1, wherein separation of the oil and acetone-containing light phase from the water, acetone, salt and cell debris containing heavy phase is realized by mechanical means.

12. The method of claim 11, wherein separation of the oil and acetone-containing light phase from the water, acetone, salt and cell debris containing heavy phase by mechanical means takes place at a pH of 5.5 to 8.5.

13. The method of claim 1, further comprising separating the acetone from the PUFAs containing oil.

14. The method of claim 1, wherein the suspension has a biomass density of at least 80 g/l.

15. The method of claim 1, wherein the suspension has a biomass density of at least 140 g/l.

16. The method of claim 1, wherein the cells which contain a PUFAs containing lipid are selected from the group consisting of: algae; fungi; protists;

bacteria; microalgae; plant cells; and mixtures thereof.

17. The method of claim 16, wherein the cells which contain a PUFAs containing lipid are microalgae selected from the phylum Stramanopiles.

18. The method of claim 17, wherein the cells which contain a PUFAs containing lipid are from the family Thraustochytrids.

19. The method of claim 18, wherein the cells which contain a PUFAs containing lipid are microalgae of the genus Schizochytrium.

20. The method of claim 5, wherein the cell-wall degrading enzyme is selected from the group consisting of: a protease, cellulase, hemicellulase, chitinase, pectinase, sucrase, maltase, lactase, alpha-glucosidase, beta-glucosidase, amylase, lysozyme, neuraminidase, galactosidase, alpha-mannosidase, glucuronidase, hyaluronidase, pullulanase, glucocerebrosidase, galactosylceramidase, acetylgalactosaminidase, fucosidase, hexosaminidase, iduronidase, maltase-glucoamylase, beta-glucanase, mannanase, and combinations thereof.

* * * * *